US005332418A

United States Patent [19]

Daussan et al.

[11] Patent Number: 5,332,418

[45] Date of Patent: Jul. 26, 1994

[54] COVERING FOR MOLTEN METAL AND PROCESS FOR PRODUCING THE SAME

[75] Inventors: Jean-Charles Daussan, Metz; Gérard Daussan; André Daussan, both of Longeville-les-Metz, all of France

[73] Assignee: Daussan et Compagnie, Longeville-Les-Metz, France

[21] Appl. No.: 36,733

[22] Filed: Mar. 25, 1993

[30] Foreign Application Priority Data

Mar. 22, 1991 [FR] France ..... 91 03515

[51] Int. Cl.[5] ..... C22B 9/10

[52] U.S. Cl. ..... 75/303; 75/304; 75/305

[58] Field of Search ..... 75/303–305

[56] References Cited

U.S. PATENT DOCUMENTS

| | | | |
|---|---|---|---|
| 4,127,407 | 11/1978 | Eitel | 75/305 |
| 4,130,423 | 12/1978 | Chastant | 75/305 |
| 4,417,924 | 11/1983 | Schwer | 75/257 |

FOREIGN PATENT DOCUMENTS

| | | |
|---|---|---|
| 2432350 | 2/1980 | France . |
| 56-62662 | 5/1981 | Japan . |
| 60-56469 | 4/1985 | Japan . |
| 44487 | 9/1963 | Luxembourg . |
| 2116092 | 9/1983 | United Kingdom . |

*Primary Examiner*—Peter D. Rosenberg
*Attorney, Agent, or Firm*—Young & Thompson

[57] ABSTRACT

A pulverulent insulating and purifying covering (3) for the surface of liquid metal (2) contained in a metallurgical receptacle (1), comprises a layer (4) which includes at least one metallic oxide of basic character, capable of reacting with oxide inclusions contained in the liquid metal. This layer (4) covers a first layer (5) in direct contact with the liquid metal and including also at least one such metallic oxide and additionally a flux (6) in a quantity sufficient to render fluid this first layer (5) under the influence of the heat of the liquid metal (2). The metallic oxide is selected from the group consisting of lime, magnesia, calcium carbonate, magnesium carbonate, calcium hydroxide, magnesium hydroxide, dolomite and a mixture thereof. Each layer (4, 5) includes a mixture of lime and magnesia. The first layer (5) in contact with the liquid metal (2) includes a substantial amount up to 30% by weight of flux, while layer (4) which covers the first layer (5) is substantially free from flux. There is added, either continuously or periodically, to the first layer (5) flux sufficient to maintain the first layer in a fluid condition under the influence of the heat of the liquid metal (2). This can be done by feeding the flux through a conduit which opens below the lower surface of the second layer (4), for example by introducing the flux into a casting tube (9) through which the liquid metal (2) has been introduced into the metallurgical receptacle (1) , or by introducing the flux through both layers ( 4, 5) and into the liquid metal so that the flux rises to the underside of the first layer (5).

15 Claims, 1 Drawing Sheet

COVERING FOR MOLTEN METAL AND PROCESS FOR PRODUCING THE SAME

The present invention relates to a covering in the form of a covering powder adapted to cover the surface of a liquid metal contained in a metallurgical receptacle such as a ladle or a tundish.

The invention also relates to the process to provide the mentioned covering.

The covering envisioned by the invention has on the one hand the function of thermal insulation. Because it covers the liquid metal, it avoids cooling of this latter.

The covering envisioned by the invention has on the other hand the function of purification. It includes for this purpose metallic oxides of a basic character such as lime and/or magnesia and/or dolomite.

These oxides are susceptible to react with or to absorb oxide inclusions and in particular alumina which pollutes the liquid metal.

The known covering powders already perform the mentioned functions. However, in each case, at least one of the functions is imperfectly performed.

Thus, to maintain its thermal insulation power, the covering powder should not melt under the heat of the liquid metal.

However, when preventing fusion of the basic oxides contained in the covering powder, the purifying power is diminished as to oxide inclusions and in particular as to alumina contained in the liquid metal.

The known covering powders therefore constitute a single layer whose composition is determined so as to obtain a certain insulating power and a certain purifying power.

The object of the present invention is to overcome the drawbacks of the known covering powders by creating a covering having substantially improved insulating and purifying powers.

The invention thus envisions a pulverulent insulating and purifying covering for the surface of a liquid metal contained in a metallurgical receptacle, comprising a layer which includes one or several metallic oxides of basic character, capable of reacting with the oxide inclusions and in particular alumina contained in the liquid metal.

According to the invention, this covering is characterized in that it includes a first layer in direct contact with the liquid metal and which includes also one or several of said metallic oxides and in addition a flux in a quantity sufficient that this layer will become fluid under the influence of the heat of the liquid metal.

Experience has thus shown that the use of a flux in the first layer permits this latter to melt, which is to say to become fluid under the effect of heat. Because of the fluidity of this layer, the oxides of basic character that it encloses "wet" to an increased extent the surface of the liquid metal, which permits them better to react with the alumina and other inclusions contained in the liquid metal.

Because the second or upper layer, without flux, remains in a powdered condition and therefore a less dense condition, its insulating power remains substantially intact.

As a result, the covering formed of the two recited layers has an insulating power and a purifying power substantially increased relative to the known single layer coverings.

Moreover, the fact that the covering layer in contact with the liquid metal will become fluid under the influence of heat, does not diminish in any way the effective life of the covering. On the contrary, the basic oxides of the second layer replace those of the first layer, to the extent that these latter are consumed by absorption of the oxide inclusions contained in the liquid metal.

Because the fluidity of the first layer decreases progressively with time because of the progressive absorption of oxide inclusions and therefore the flux content progressively decreases, the invention provides a process which comprises the following steps:

- spreading on the surface of the liquid metal the first pulverulent layer including the metallic oxide or oxides of basic character and the flux,
- spreading on this first layer a second pulverulent layer including the metallic oxide or oxides of basic character, but comprising substantially less flux than the preceding layer, and
- adding periodically or continuously to the first layer a certain quantity of flux to maintain this layer in the desired fluid condition under the influence of the heat of the liquid metal.

According to a preferred embodiment of the invention, the metallic oxides contained in the two covering layers are selected from the group consisting of lime, magnesia, calcium carbonate, magnesium carbonate, calcium hydroxide, magnesium hydroxide, dolomite and a mixture of two or more of these compounds.

Preferably, each layer includes a mixture of lime and magnesia.

Other characteristics and advantages of the invention will become apparent from the following description:

In the accompanying drawing given by way of non-limiting example:

Figure 1:
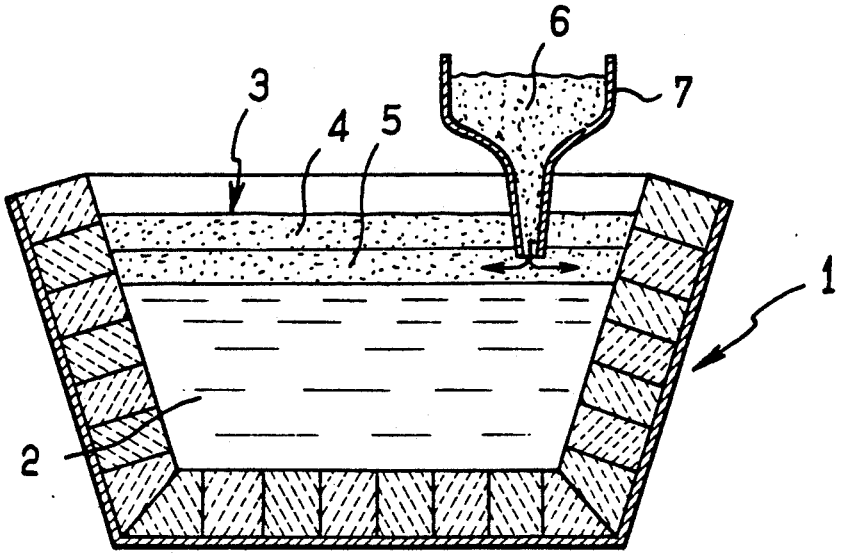
FIG. 1 is a transverse cross-sectional view of a tundish, showing a two-layer covering and its arrangement for flux supply.

In FIG. 1, there is shown a tundish 1 enclosing liquid metal 2, for example liquid steel whose temperature is of the order of 1,400° C.

The surface of the liquid metal is covered by a pulverulent covering 3 having both insulating properties (to avoid cooling of the liquid metal) and purifying properties (to absorb oxide inclusions, in particular alumina, from the liquid metal).

This covering 3 comprises a layer 4 which includes one or several metallic oxides of basic character, capable of reacting with the oxide inclusions and in particular the alumina contained in the liquid ferrous metal.

The layer 4 covers a first layer 5 in direct contact with the liquid metal 2 including also one or several of said metallic oxides and additionally a flux 6 in a quantity sufficient that layer 5 will become fluid under the influence of the heat of the liquid metal 2.

The metallic oxides contained in the layers 4 and 5 are preferably selected from the class consisting of lime, magnesia, calcium carbonate, magnesium carbonate, calcium hydroxide, magnesium hydroxide, dolomite and a mixture of two or more of these compounds.

Each layer preferably includes a mixture of lime and magnesia.

The first layer in contact with the liquid metal can include up to 30% by weight of a flux, while the layer which covers it is substantially free from flux.

The liquid metal being at a temperature of about 1,400° C., the quantity of flux is selected such that the layer 5 will melt at a temperature generally comprised between 1,200 and 1,400° C.

Preferably, the layer 4 which covers the first layer 5 contains between 60 and 85% by weight of lime and/or magnesia.

This layer 4 includes moreover a carbon base pulverulent material, such as powdered coke or graphite to prevent reoxidation, decreasing the density of this layer 5 and as a result increasing its insulating power.

Preferably, the layer 4 includes moreover a low density material having thermal insulating properties, such as vermiculite or perlite.

By way of example, the flux 6 added to the layer 5 is selected from the group consisting of fluorspar, silica, bauxite, iron oxides, potassium or sodium oxides or their silicates, alkali carbonates and borates, blast furnace slag, boron oxides, boron derivatives and a mixture of these compounds.

There are given hereafter several non-limiting examples of composition of the layer 4 of the covering according to the invention.

| | |
|---|---|
| Example 1: | |
| CaO | 35% by weight |
| MgO | 41.7% by weight |
| Graphite | 20% by weight |
| Wood flour | 3.3% by weight |
| Example 2: | |
| Powdered coke | 8% by weight |
| Graphite | 12.5% by weight |
| Powdered graphite | 5% by weight |
| Bauxite (80% $Al_2O_3$) | 11% by weight |
| Blast furnace slag (including 12% lime) | 41% by weight |

There is given hereafter a list of chemical compounds with their melting point, that can serve as flux:

| | |
|---|---|
| $B_2O_3$: | 450° C. |
| Fluorspar ($CaF_2$): | 1,403° C. |
| Aluminum fluoride: | 1,040° C. |
| Bauxite ($Al_2O_3$, MgO): | 1,300–1,400° C. |
| Sodium carbonate: | 860° C. |
| Potassium carbonate: | 896° C. |
| Sodium silicate: | 874° C. |

To obtain a layer 5 which can melt under the influence of the heat of the liquid metal, it suffices to add a predetermined quantity of flux to a composition identical to that of layer 4.

Thus, according to the nature of the flux, the content of this latter can vary between 5 and 30% by weight.

To provide the covering according to the invention, one proceeds as follows:

One spreads on the surface of the liquid metal 2, the first pulverulent layer 5 including the metallic oxide or oxides of basic character and the flux 6, one spreads on this first layer 5, a second pulverulent layer 4 including the metallic oxide or oxides of basic character, but substantially lacking flux, and one adds periodically or continuously to the first layer 5 a certain quantity of flux 6 to maintain this layer 5 in the desired fluid state under the influence of the heat of the liquid metal.

In the case of FIG. 1, the flux 6 is added to the first layer, by pouring this flux into a hopper 7 which opens below the lower surface of said second layer 4.

Figure 2:
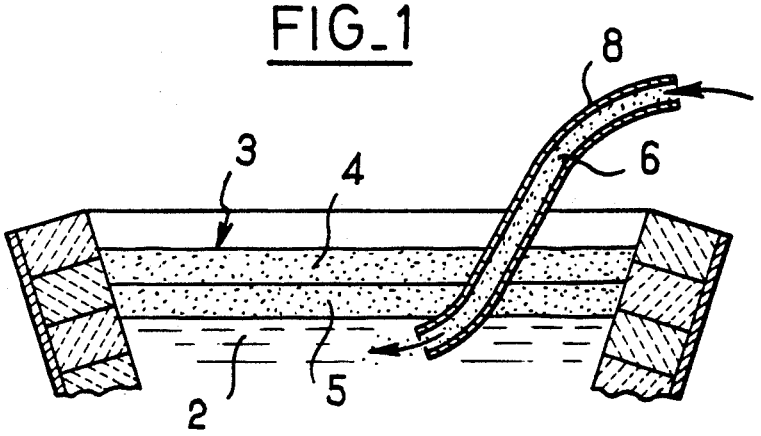
FIG. 2 is a fragmentary cross-sectional view of the tundish, showing a second device for flux supply.

In the case of FIG. 2, the flux 6 is added to the first layer 5 by means of a conduit 8 which passes through the two layers 4, 5 and which opens into the liquid metal, slightly below the lower surface of the layer 5.

Because of the relatively low density of the flux 6, the latter automatically rises against the layer 5.

Figure 3:
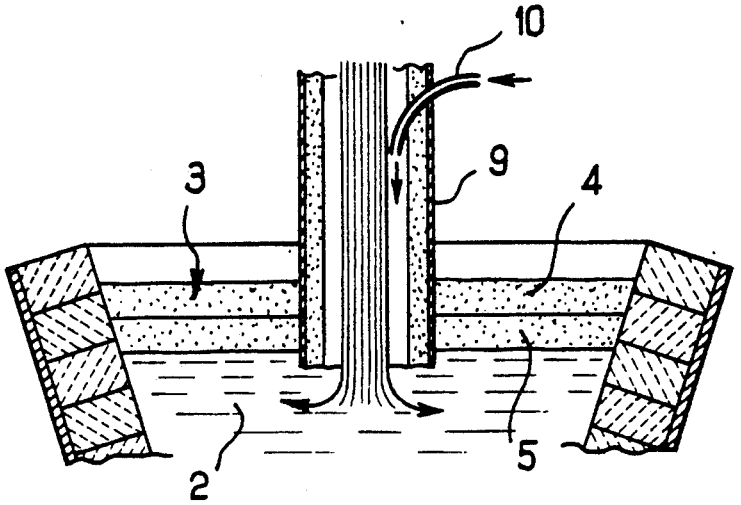
FIG. 3 is a view similar to FIG. 2 showing a casting tube immersed in the liquid metal, the flux supply being effected by said tube.

In the case of FIG. 3, the flux is added to the layer 5, by introducing into the casting tube 9 at least one tubing 10.

Because of the presence of the flux 6 in the layer 4 which is in direct contact with the liquid metal 2, this latter melts under the influence of heat and becomes relatively fluid. This fluidity permits the layer 4 to "wet" very well the surface of the liquid metal and as a result to absorb very well the oxide inclusions and particularly the alumina which pollutes the liquid metal.

The absorption of these oxide inclusions by the basic oxides (CaO and MgO, dolomite) contained in the layer 5, will impoverish this latter of basic oxides.

However, this impoverishment of basic oxides is compensated by the continuous migration of these oxides from the second layer 4. This migration of basic oxides tends to decrease the fluidity of the layer 5 which is compensated by a periodic or continuous addition of flux 6.

Moreover, the second layer 4, substantially free from flux, remains pulverulent and hence preserves its insulating properties, which avoids any risk of excessive cooling of the liquid metal.

Of course, the invention is not limited to the embodiments which have been described and there could be brought to these numerous modifications without departing from the scope of the invention.

Thus, by way of modification, one could introduce low melting flux into the layer 4 which permits regenerating the layer 5 by migration of flux from layer 4.

What is claimed is:

1. A pulverulent insulating and purifying covering (3) for the surface of liquid metal (2) contained in a metallurgical receptacle (1), comprising an upper layer (4) which includes at least one metallic oxide of basic character, capable of reacting with oxide inclusions contained in the liquid metal; and a lower layer (5) in direct contact with the liquid metal and covered by said upper layer (4) and including at least one said metallic oxide and additionally a flux (6) in a quantity sufficient to render fluid said first layer (5) under the influence of the heat of the liquid metal (2), said lower layer containing substantially more said flux (6) than said lower layer.

2. A tundish containing liquid metal and a pulverulent insulating and purifying covering according to claim 1, on the surface of said metal.

3. A process for providing a pulverulent insulating and purifying covering (3), comprising spreading on the surface of liquid metal (2) a pulverulent insulating and purifying covering that includes at least one metallic oxide of basic character, and feeding a flux through a conduit through at least an upper portion of said covering in a quantity sufficient to maintain a lower portion only of said purifying covering in fluid condition under the influence of the heat of the liquid metal.

4. A process according to claim 3, wherein said conduit extends through said covering and into said liquid metal.

5. A pulverulent covering according to claim 1, wherein said metallic oxide is selected from the group consisting of lime, magnesia, calcium carbonate, magnesium carbonate, calcium hydroxide, magnesium hydroxide, dolomite and a mixture thereof.

6. A pulverulent covering according to claim 5, wherein each said layer (4, 5) includes a mixture of lime and magnesia.

7. A pulverulent covering according to claim 1, wherein said lower layer (5) in contact with the liquid metal (2) includes a substantial amount up to 30% by weight of flux, while said upper layer (4) which covers said lower layer (5) is substantially free from flux.

8. A pulverulent covering as claimed in claim 1, wherein said upper layer (4) which covers said lower layer (5) contains between 60 and 85% by weight of a member selected from the group consisting of lime, magnesia and a mixture thereof.

9. A pulverulent covering according to claim 1, wherein said upper layer (4) which covers said lower layer (5) includes a pulverulent carbon base material.

10. A pulverulent covering according to claim 1, wherein said upper layer (4) which covers said lower layer (5) includes a low density material having thermal insulation properties.

11. A pulverulent covering according to claim 1, wherein said flux is selected from the group consisting of fluorspar, silica, bauxite, iron oxide, sodium oxide, potassium oxide, sodium silicate, potassium silicate, alkali carbonate, alkali borate, blast furnace slag, boron oxide, boron derivatives and a mixture thereof.

12. A process for providing a pulverulent insulating and purifying covering (3), comprising the following steps:

spreading on the surface of liquid metal (2) a first pulverulent layer (5) including at least one metallic oxide of basic character and a flux (6), spreading on said first layer (5) a second pulverulent layer (4) including at least one basic metallic oxide but substantially less flux than said first layer (5), and adding to the first layer (5) flux sufficient to maintain said first layer in a fluid condition under the influence of the heat of the liquid metal (2).

13. A process according to claim 12, wherein the flux (6) is added to the first layer (5) by feeding the flux through conduit means which opens below the lower surface of the second layer (4).

14. A process according to claim 12, wherein the flux (6) is added to the first layer (5) by introducing the flux into a casting tube (9) through which the liquid metal (2) has been introduced into a metallurgical receptacle (1).

15. A process according to claim 12, wherein the flux is introduced through both said layers (4, 5) and into the liquid metal and then rises to the underside of said first layer (5).

* * * * *